US005291727A

United States Patent [19]

Stahlecker et al.

[11] Patent Number: 5,291,727

[45] Date of Patent: Mar. 8, 1994

[54] SPINNING MACHINE SYSTEM HAVING A PLATFORM SUPPORTED ON SPINNING MACHINE FRAMES

[76] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[21] Appl. No.: 850,302

[22] Filed: Mar. 12, 1992

[30] Foreign Application Priority Data

Mar. 20, 1991 [DE] Fed. Rep. of Germany ..... 4109128

[51] Int. Cl.[5] ..... D01H 13/04

[52] U.S. Cl. ..... 57/90; 57/315

[58] Field of Search ..... 57/90, 315

[56] References Cited

U.S. PATENT DOCUMENTS 3,191,375 6/1965 Naegeli ..... 57/315 X 3,564,829 2/1971 Tsuzuki ..... 57/90 X

FOREIGN PATENT DOCUMENTS 817572 10/1951 Fed. Rep. of Germany .

882068 7/1953 Fed. Rep. of Germany .

*Primary Examiner*—Joseph J. Hail, III

*Attorney, Agent, or Firm*—Evenson, McKeown, Edwards & Lenahan

[57] ABSTRACT

The case of a spinning machine system with several adjacently arranged ring spinning machines to the spinning stations of which one sliver respectively is fed, which is deposited in a can, it is provided that the cans are set up on a platform situated above the ring spinning machines. Conveyor belts lead from the cans to the individual spinning stations. The cans are arranged in rows in such a manner that the interior rows of two machine sides facing the center plane of the respective ring spinning machine have a distance from one another which corresponds to approximately 1/10 to 1/4 of the distance between the exterior rows of cans of two adjacent ring spinning machines.

15 Claims, 2 Drawing Sheets

SPINNING MACHINE SYSTEM HAVING A PLATFORM SUPPORTED ON SPINNING MACHINE FRAMES

BACKGROUND AND SUMMARY OF THE INVENTION

The invention relates to a spinning machine system having at least one ring spinning machine which comprises a plurality of spinning stations arranged next to one another on both sides of the machine to which one sliver respectively is assigned which is to be spun and is fed from a can. The cans are deposited in several rows for each side of the machine on a platform situated above the ring spinning machine The slivers are guided to the spinning stations in the area of the center plane of the ring spinning machine.

It has long been a goal to provide so-called short spinning processes in which, while the flyer is omitted, the slivers coming from the drafting frames are fed directly to a ring spinning machine in cans. It was attempted to achieve the drafting work of the omitted flyer in addition by means of the drafting units of the ring spinning machine. These experiments failed in practice. Examples are the German Patents 882 068 and 817 572.

So that the drafting work on the ring spinning machine remains within acceptable limits when a drafting frame sliver is fed in cans, it was suggested in older German patent applications, which are no prior publications, to produce finer slivers than previously customary on the drafting frame, for example, of a size ranging from Nm 0.4 to 0.8. In this case, different possibilities are indicated in the mentioned patent applications in order to securely take the very fine slivers, without any faulty drafting, from the cans to the spinning stations In the German Patent Application P 40 38 231.1 (PA 1163, P 9321) corresponding to U.S. application Ser. No. 07/799,130, filed Nov. 27, 1991, it is suggested to rotate the fed cans during the spinning operation about their longitudinal axis so that the respective sliver receives a true protective twist. In the Patent Application P 40 41 112.5 (PA 1170, P 9342), corresponding to U.S. application Ser. No. 07/809,141, filed Dec. 18, 1991, now abandoned in favor of U.S. continuation-in-part application Ser. No. 07/948,638, filed Sept. 23, 1992, it is suggested to convey the slivers from the cans to the spinning stations by means of guiding devices, such as conveyor belts.

It is an object of the invention to provide a spinning machine system for ring spinning machines with a drafting frame sliver feeding of the initially mentioned type in which, while the space requirements are low, an advantageous apportioning of space is achieved.

This object is achieved in that the rows of cans of adjacently set-up ring spinning machines are arranged in such a manner that the interior rows of two machine sides, which face the center plane, have a distance from one another which corresponds to approximately 1/10 to ¼ of the distance of the exterior rows of the cans of two adjacent ring spinning machines.

While retaining the advantages of the mentioned patent applications which are no prior publications, a favorable utilization of space is ensured, the advantages of which will be explained particularly in the following description of two embodiments.

Other objects, advantages and novel features of the present invention will become apparent from the following detailed description of the invention when considered in conjunction with the accompanying drawings.

DETAILED DESCRIPTION OF THE DRAWINGS

Figure 1:
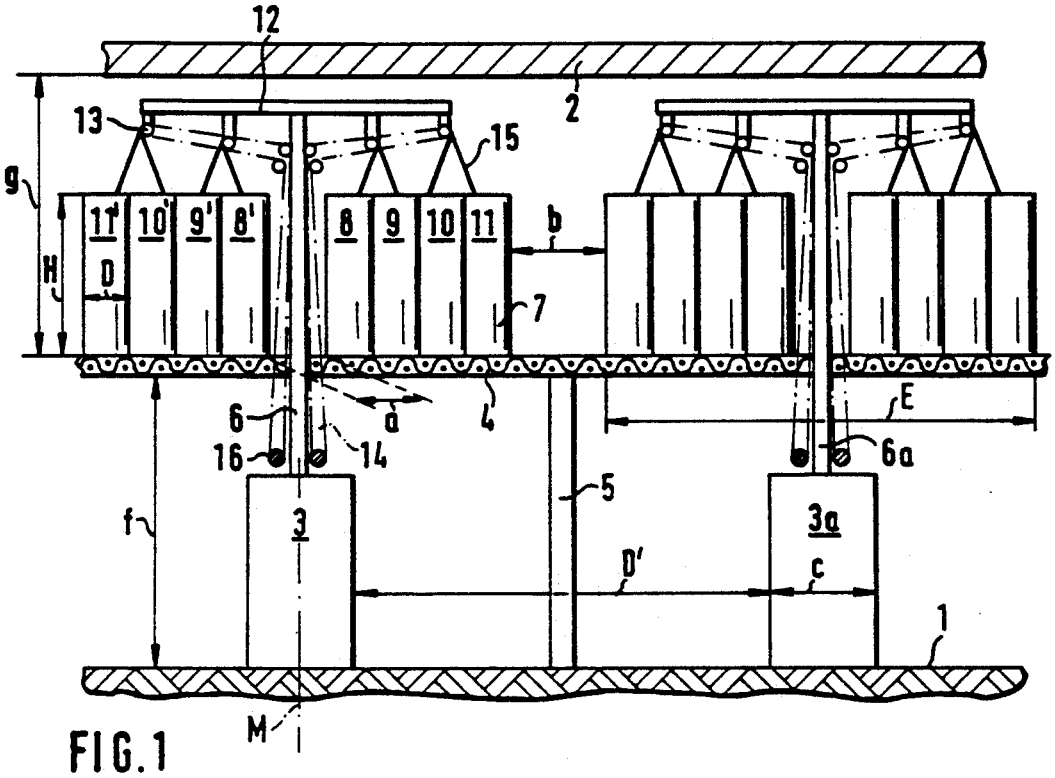
FIG. 1 is a partial schematic view of a spinning machine system constructed according to a preferred embodiment of the invention with two ring spinning machines and rows of cans deposited on a platform above them, four rows being provided for each machine side.

In the figures, reference number 1 is the floor and reference number 2 is the ceiling of a spinning room. Of the spinning machine system, two ring spinning machines 3 and 3a, which are arranged next to one another, are shown schematically. Above the ring spinning machines 3, 3a, a platform 4 is situated which is designed as a grid construction and which, in the embodiment according to FIG. 1, is supported on supports 5 on the floor 1. In addition, the platform 4 is supported by means of masts 6 and 6a on the frame walls 19 (see also FIG. 3) of the ring spinning machines 3, 3a. In contrast, in the embodiment according to FIG. 2, the platform 4 is held only by means of the masts 6, 6a.

On the platform 4, the cans 7 are deposited for the sliver 15 to be spun directly. In the embodiment according to FIG. 1, four rows 8, 9, 10 and 11 as well as 8', 9', 10' and 11' of cans 7 are arranged for each machine side. In contrast, in the embodiment according to FIG. 2, only three rows 8, 9 and 10 as well as 8', 9' and 10' of cans 7 are provided for each machine side.

Above the cans 7, the masts 6, 6a carry crossmembers 12 to which rollers 13 are fastened. The rollers 13 as well as additional guide rollers fastened to the mast 6, 6a guide a conveyor belt 14, specifically one for each machine side. Additional elements may be assigned to the conveyor belt 14 as described, for example, in the Patent Application P 40 41 112.5. By means of the conveyor belts 14, the slivers 15 fed in the cans 7 are conveyed to the individual spinning stations 17 (see FIG. 3). Driving rollers 16, which are arranged in the vicinity of the spinning stations 17 and extend in the longitudinal direction of the machine, are used for driving the conveyor belts 14.

A plurality of spinning stations 17 is, in each case, combined to a section 18 of the pertaining ring spinning machine 3 or 3a. The individual sections 18 are separated from one another by means of frame walls 19.

Figure 3:
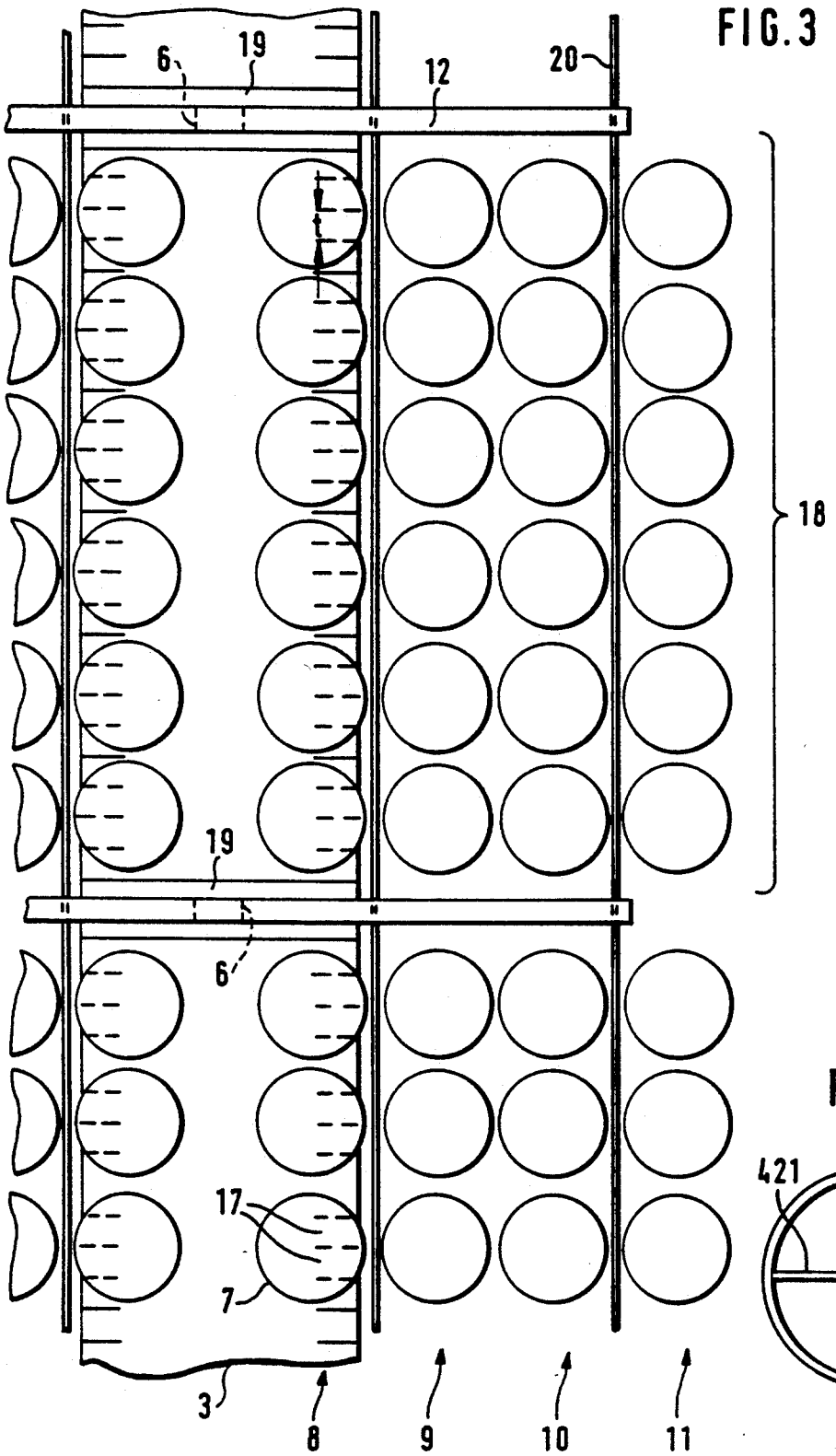
FIG. 3 is a partial view of FIG. 1 from above, in which several structural members were omitted.

As also illustrated in FIG. 3, the crossmembers 12 are connected by means of rods 20 which extend in the longitudinal direction of the machine and on which crossmembers 12 the mentioned rollers 13 are pivotally mounted.

The individual spinning stations 17, according to FIG. 3, have a division t, this division t being the distance between the centers of two spinning stations 17.

This division t must in no case be larger than 80 mm, the optimum being 75 mm.

With respect to the cans 7, the optimum is an outside diameter which is no larger than 4 times the spindle gauge t. Thus an outside diameter D (see FIG. 1) is obtained which has 280 mm has its optimum. In this case, the inside diameter is 10" or slightly less. The enlargements at the upper edge of the cans 7 as well as in the lower area, which are customary today, are less advantageous in the case of this arrangement and should be as small as possible or should be eliminated completely.

The height H of the cans 7 (see FIG. 1) should be larger than is generally customary today, specifically slightly more than 1 m.

Figure 4:
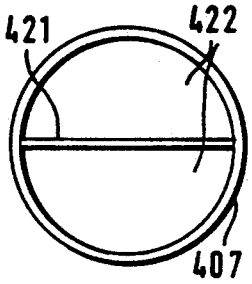
FIG. 4 is a special design of a can in which two slivers are deposited.

As an alternative, according to FIG. 4, cans 407 are contemplated which have twice the diameter if they are divided into two chambers 422 for two slivers 15 by means of a partition 421. In the case of such two-sliver cans 407, the outside diameter should not be far below 8 times the spindle gauge 1, therefore approximately 580 mm.

According to FIG. 1, four rows 8 to 11 of cans 7 for each machine side were found to be advantageous. Between the interior rows 8, 8' of cans 7 facing the center plane M of the ring spinning machines 3, 3a, there is a narrow gap of a distance a, which is to be between 10 and 20 cm and definitely not significantly above such a measurement. The masts 6, 6a as well as the conveyor belts 14 extend in this gap.

Figure 2:
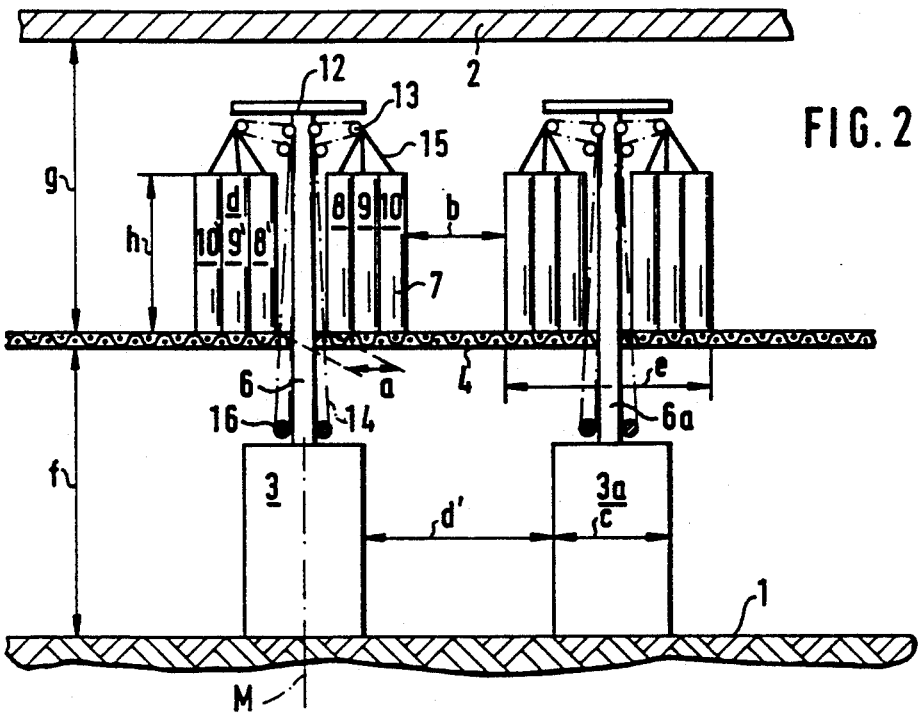
FIG. 2 is a partial schematic view similar to FIG. 1 of a spinning machine system constructed according to another preferred embodiment of the invention, with three rows of cans being provided for each machine side.

When there are four rows 8 to 11 of cans 7 according to FIG. 1, the clear distance D between two ring spinning machines 3 and 3a is in the order of 2.5 m. When only three rows 8 to 10 of cans 7 according to FIG. 2 are used, this distance d may be reduced to approximately 1.5 m. The distance between the exterior rows 11 of cans 7 of two adjacent ring spinning machines 3 and 3a amounts to b and is in the order of from 0.8 to 1.0 m. Thus, the measurement a is 1/10 to ¼ of measurement b.

When there are four rows 8 to 11 as well as 8' to 11' of cans 7, the total width E is in the order of the clear distance D of the adjacent ring spinning machines 3 and 3a. Correspondingly, according to FIG. 2, in the case of three rows of cans 8 to 10 as well as 8' to 10', this also applies to the measurement e which is in the order of the measurement d. The width c of the ring spinning machines 3 and 3a is in the order of the distance b and preferably amounts to approximately 0.8 m.

So that the cans 7 run as long as possible, specifically for the duration of approximately one week, the height H (FIG. 1) or h (FIG. 2) should be as large as possible, specifically more than 1 m. In this case, height h is larger than height H since the diameter d of cans 7 according to FIG. 2 is slightly smaller than the diameter D of cans 7 according to FIG. 1.

The masts 6, 6a are constructed as rectangular profiles. The dimensions must be very narrow, for example, 10×70 mm, so that there will be no conflict with respect to the conveyor belts 14.

The clear distance f and g of the platform 4 from the floor 1 and the ceiling 2 should be selected to be such that operating personnel have a reasonable amount of working space above as well as below the platform 4. In this case, distance f, as a rule, is slightly larger than distance g. In each case, it is slightly more than 2 m.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A spinning machine system comprising:

at least two ring spinning machines which are parallel to one another on a floor of a spinning room, each ring spinning machine having a machine frame and two machine sides, with both machine sides having a plurality of spinning stations arranged next to one another, with individual slivers being respectively provided from cans and fed to the spinning stations as the fiber material to be spun;

a platform arranged at a height of approximately two meters above the floor of the spinning room;

supports on the machine frames, the supports providing at least partial support of the platform;

transport devices having a drive provided between the cans and the spinning stations and which remove the slivers from the cans and non-draftingly transport the slivers to the spinning stations, the transport devices penetrating the platform in an area of a longitudinal center plane of the pertaining ring spinning machine;

wherein the cans are deposited above the ring spinning machines on the platform in several rows on both sides of the longitudinal center plane of each of the ring spinning machines, and the distance between the ring spinning machines corresponds approximately to twice the product of the diameter of one can and the number of the rows of cans required for one side of the machine.

2. A spinning machine system according to claim 1, wherein some of the rows of cans are interior rows, and wherein the interior rows of cans of a ring spinning machine have a distance of from 0.1 to 0.2 m from one another.

3. A spinning machine system according to claim 2, wherein some of the rows of cans are exterior rows, and wherein the exterior rows of cans of two adjacent ring spinning machines have a distance of from 0.8 to 1 m from one another.

4. A spinning machine system according to claim 3, wherein width between two adjacent ring spinning machines corresponds to approximately the space requirement of the rows of the cans of a ring spinning machine.

5. A spinning machine system according to claim 4, wherein the spacing of the spinning stations of a ring spinning machine amounts to maximally 80 mm.

6. A spinning machine system according to claim 5, wherein the diameter of the cans is smaller than 4 times a distance between centers of two adjacent spinning stations.

7. A spinning machine system according to claim 6, wherein the spinning machines include means for supporting the platform between the two ring spinning machines.

8. A spinning machine system according to claim 7, wherein the ring spinning machines include means for supporting the platform on the ring spinning machines.

9. A spinning machine system according to claim 1, wherein some of the rows of cans are exterior rows, the exterior rows of cans of two adjacent ring spinning machines having a distance of from 0.8 to 1 m from one another.

10. A spinning machine system according to claim 1, wherein a width between two adjacent ring spinning machines corresponds to approximately the space requirement of the rows of the cans of a ring spinning machine.

11. A spinning machine system according to claim 1, wherein the spacing of the spinning stations of a ring spinning machine amounts to maximally 80 mm.

12. A spinning machine system according to claim 1, wherein the diameter of the cans is smaller than 4 times a distance between centers of two adjacent spinning stations.

13. A spinning machine system according to claim 1, wherein the diameter of the cans is smaller than 8 times a distance between centers of two adjacent spinning stations and that each can contains two slivers.

14. A spinning machine system according to claim 1, wherein the spinning machines include means for supporting the platform between the two ring spinning machines.

15. A spinning machine system according to claim 1, wherein the ring spinning machines include means for supporting the platform on the ring spinning machines.

* * * * *